United States Patent [19]

Fountain et al.

[11] 4,104,157

[45] * Aug. 1, 1978

[54] FLOTATION OF SULFIDE MINERALS

[75] Inventors: Gerald F. Fountain; Jaime Veloz; Edward A. Bilson; John A. Cronin, all of Inspiration, Ariz.

[73] Assignee: Inspiration Consolidated Copper Company, Morristown, N.J.

[ * ] Notice: The portion of the term of this patent subsequent to Jun. 7, 1994, has been disclaimed.

[21] Appl. No.: 685,544

[22] Filed: May 12, 1976

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 955,012 | 4/1910 | Sulman | 209/166 |
| 1,370,366 | 3/1921 | Sayre | 209/166 |
| 2,012,609 | 8/1935 | Lenber | 209/166 |
| 2,023,388 | 12/1935 | Harris | 207/166 X |
| 2,362,432 | 11/1944 | Cahn | 209/166 |
| 3,220,551 | 11/1965 | Moyer | 209/167 |
| 3,353,671 | 11/1967 | Bikales | 209/166 |
| 3,710,939 | 1/1973 | Hostynek | 209/166 |
| 4,028,235 | 6/1977 | Fountain | 209/166 X |

FOREIGN PATENT DOCUMENTS

| | | | |
|---|---|---|---|
| 2,359 of | 1910 | United Kingdom | 209/166 |

*Primary Examiner*—Robert Halper

*Attorney, Agent, or Firm*—Pennie & Edmonds

[57] ABSTRACT

This invention relates to the process of flotation concentration of a sulfide mineral in which an aqueous pulp of an ore containing such mineral is subjected to a flotation operation to produce a final high-grade flotation concentrate of such mineral, the improvement comprising carrying out said flotation with a polyglycerol present in the aqueous pulp in an amount sufficient to increase recovery of such mineral in the final concentrate over that obtainable without the presence of said polyglycerol.

10 Claims, No Drawings

FLOTATION OF SULFIDE MINERALS

BACKGROUND OF THE INVENTION

The efficiency of flotation of sulfide minerals is controlled by a number of variables, one of which is the particle size and configuration of the material being floated. In general, the greater the quantity of slime bearing constituents, the poorer the separation of minerals in gangue. In most primary copper deposits, the naturally occurring slimes and that produced by beneficiation are of sufficient quantity to detrimentally affect overall flotation recoveries.

Attempts to avoid slime formation have included efforts to eliminate fine grinding. As an example, some mill feed are ground to run roughly 50% minus 200 mesh and 40% minus 325 mesh. Such a grind is necessary for optimum liberation of the desired minerals. If not ground fine enough, slime formation may be avoided, but the recovery of the desired mineral is low. This grind range does not, however, indicate the true slime content of the material. The primary slimes or slimes not produced by beneficiation tend to have a greater affect on flotation. In order words, the particle size distribution below the −325 range and particularly the fractions approaching the micron range are the controlling factors. These slimes vary with the mining areas to such a degree that various areas allow extremely poor physical control of the flotation operation.

Addition of chemicals to suppress the detrimental effect of slimes has been tried with some minor success, but such chemicals do not sufficiently improve the grade of rougher concentrates so as to permit a more efficient cleaner flotation circuit.

SUMMARY OF THE INVENTION

The present invention provides an improved flotation process for sulfide minerals which minimizes the collection of slimes in the rougher concentrate thereby lowering the weight and increasing the grade thereof.

Briefly stated, the present invention comprises an improvement in the process of flotation concentration of a sulfide mineral in which an aqueous pulp of an ore containing such mineral is subjected to a flotation operation to produce a final high grade flotation concentrate of such mineral, the improvement comprising carrying out said flotation with a polyglycerol present in the aqueous pulp in an amount sufficient to increase recovery of such mineral in the final concentrate over that obtainable without the presence of said polyglycerol.

DETAILED DESCRIPTION

The details of the rougher and cleaner flotations are well known to those skilled in this art. Any of the procedures and apparatus used for or conventional for such flotations can be used in carrying out the instant invention. Consequently, they will not be described in any detail herein.

In like manner, while the instant invention is applicable to flotation concentration of all sulfide minerals where slime is a problem, such as sulfidic copper, nickel, zinc, silver, molybdenum ores, and the like, it will be discussed in connection with copper sulfide minerals.

In accordance with the present invention, the copper sulfide containing ore is prepared for flotation concentration in the usual manner. That is, the ore is ground, as to minus 200 mesh (Tyler Standard) or finer, and slurried with water to form an aqueous flotation pulp. The particle size can vary widely dependent upon the ore to be floated and it is common commercial practice to blend batches of ore of various particle sizes. Also the concentration of ore solids in the flotation pulp can differ widely. The particle size, or size range of the ore feed used to form the flotation pulp and concentration of solids in the pulp are chosen in the usual manner to be the ones giving the best flotation concentration for the ore being treated.

The important and critical feature of the present invention is the addition of a polyglycerol to the aqueous flotation pulp prior to flotation. The polyglycerol can be added to the water used to form the flotation pulp or directly to the aqueous pulp once it is formed.

The polyglycerol must be added in an amount sufficient to increase recovery of the desired mineral. Ordinarily, this can be accomplished with the addition of as little as about 0.5 parts per million polyglycerol. With sulfidic ores having very high levels of naturally occurring slimes or with difficult to float ores, it may be necessary to use at least 0.7 or 1 ppm of the polyglycerol. Levels of polyglycerol up to 100 ppm can be added, if desired, but are not necessary. In addition, levels much above 100 ppm can have an adverse effect on the rougher and cleaner concentrates. Preferably, from about 0.5 to 10 ppm polyglycerol is used.

The polyglycerols used are viscous liquids comprising mixtures of ethers of glycerol with itself, ranging from diglycerol to triacontaglycerol, which are soluble in water, alcohol, and other polar solvents. The molecular weights and boiling points of a particular polyglycerol mixture will vary dependent upon the proportions of particular ethers present therein. For the purposes of the present invention, it is most desirable to use polyglycerols containing a major proportion of a mixture of glycerol, diglycerol, triglycerol, tetraglycerol, and pentaglycerol (about 55% to 80% by weight of the total weight of the polyglycerol) with the remainder being the higher ethers. The preferred polyglycerols are highly viscous and, for ease of use, they can be diluted with water; as by adding about 20% to 30% water. Commercially available polyglycerols are known to also contain minor amounts, 3% to 6% by weight, of sodium salts, such as NaCl and $Na_2CO_3$. Examples are HL-70 and 80 by Mining & Industrial Chemicals. It has been found that this minor amount of salt does not have any significant effect on the performance of the polyglycerols and, thus, they can be used as commercially available.

As to the desired polyglycerols, they should not contain more than about 15% by weight of glycerol and, preferably, the range of glycerol and its ethers based on the total weight of the undiluted polyglycerol is as follows:

| | % by Weight |
|---|---|
| Glycerol | 8 – 14 |
| Diglycerol | 24 – 30 |
| Triglycerol | 10 – 14 |
| Tetraglycerol | 7 – 10 |
| Pentaglycerol | 6 – 9 |
| Heavier polyglycerols | Balance |

In addition, it has been found that minor amounts of glycols can be substituted for a portion of the polyglycerols and the resulting compositions will also function satisfactorily. For example, compositions comprising up to 30% alkylene glycols, such as dipropylene glycol, can be used.

The invention will be further described in connection with the following examples which are set forth for purposes of illustration only and in which proportions are by weight unless expressly stated to the contrary.

EXAMPLE I

Tests were made on the flotation of a clay slime copper ore which was 100% minus 200 mesh. This material was predominantly naturally occurring slimes. Table I indicates the results of the addition of polyglycerol (HL-80) directly to flotation.

TABLE I

| Polyglycerol (ppm) | Wt. % Rougher Conc. | Grade of Rougher Conc. % Cu |
|---|---|---|
| 0 | 4.93 | 5.50 |
| 0.7 | 2.59 | 8.93 |
| 2.0 | 2.83 | 8.46 |
| 3.3 | 2.44 | 9.76 |
| 4.6 | 2.48 | 9.30 |
| 6.5 | 2.64 | 8.59 |

Table I indicates that the addition of 3 ppm polyglycerol will reduce the weight of the rougher concentrate by 50%. The recovery of copper was not adversely affected by the additions of polyglycerol.

EXAMPLE 2

Tests were made on regular mill feed copper ore which was easily flotable and in which polyglycerol was added to tap water before the water was used in flotation. Table II indicates the results of addition of polyglycerol (HL-80) to tap water.

TABLE II

| Polyglycerol (ppm) | Wt. % Rougher Conc. | Grade of Rougher Conc. % Cu |
|---|---|---|
| 0 | 2.41 | 23.26 |
| 1 | 2.30 | 22.06 |
| 10 | 2.24 | 24.06 |
| 100 | 2.09 | 25.04 |
| 1000 | 2.42 | 20.80 |

Table II indicates no major change in the weight of the rougher concentrate was obtained with polyglycerol until additions of 100 ppm polyglycerol reduced the weight of the rougher concentrate by a significant 13%. The ore used in this test series generally produced a good grade of rougher concentrate.

EXAMPLE 3

Polyglycerol (HL-80) was again added to tap water and was used to float copper sulfide ore which tends to make a higher weight of rougher concentrate and was a difficult to float ore. The results are set forth in Table III.

TABLE III

| Polyglycerol (ppm) | Wt. % Rougher Conc. | Grade of Rougher Conc. % Cu |
|---|---|---|
| 0 | 2.27 | 11.22 |
| 1 | 1.30 | 18.72 |
| 10 | 1.45 | 19.78 |
| 100 | 1.54 | 19.10 |
| 1000 | 2.01 | 12.52 |

This test series showed a very significant 43% reduction in the weight of rougher concentrate with just 1 ppm polyglycerol added and improved grades of rougher concentrate.

Examples 1, 2 and 3 show primary that polyglycerol can be added to flotation in order to improve the grade of the rougher concentrate. The positive effects of an improved rougher concentrate would be in the cleaner flotation circuit. By lowering the quantity of feed to the cleaner circuit, the cleaner circuit can be operated more efficiently, producing a higher grade final concentrate and a lower grade cleaner tail.

EXAMPLE 4

A test was made on a cleaner circuit with 5 ppm polyglycerol (HL-80) added to a pulp having the calculated head shown in Table IVa. The results are set forth in Table IVa.

TABLE IVa

| | Calc. Head | Cleaner Conc. | Conc. % Rec. | Rougher Tail | Cleaner Tail | % in Cln.Tail |
|---|---|---|---|---|---|---|
| Tot.Cu % | 0.216 | 7.80 | 56.48 | 0.085 | 0.612 | 5.56 |
| Sul Cu % | 0.053 | 2.71 | 79.24 | 0.010 | 0.049 | 1.89 |
| Ox Cu % | 0.162 | 5.09 | 48.77 | .075 | 0.563 | 6.79 |
| Ag oz/ton | 4.49 | 221.00 | 76.84 | 0.940 | 6.800 | 2.89 |
| Au oz/ton | — | 0.20 | — | Trace | 0.020 | — |
| % Tot.Wt. | 100 | 1.56 | | 96.47 | 1.97 | — |

A previous cleaner test without polyglycerol produced the following results:

TABLE IVb

| | Calc. Head | Cleaner Conc. | Conc. % Rec. | Rougher Tail | Cleaner Tail | % in Cln.Tail |
|---|---|---|---|---|---|---|
| Tot.Cu % | 0.210 | 10.570 | 53.33 | 0.081 | 0.963 | 9.53 |
| Sul Cu % | 0.041 | 2.758 | 70.73 | 0.010 | 0.087 | 4.88 |
| Ox Cu % | 0.169 | 7.812 | 48.82 | 0.071 | 0.876 | 10.59 |
| Ag oz/ton | 4.240 | 266.600 | 66.75 | 0.960 | 23.300 | 11.32 |
| Au oz/ton | — | 0.400 | | Trace | 0.040 | — |
| % Tot.Wt. | 100 | 1.06 | | 96.87 | 2.07 | — |

The cleaner test with polyglycerol produced a little lower grade of concentrate with a better recovery in the cleaner resulting in a 3% Cu and 10% Ag higher recovery in the final concentrate.

It should be noted that the usual flotation reagents (such as collectors, frothers, depressing agents, activating agents, and the like) added to the flotation pulps can be used in their usual amounts and for their usual effects; the polyglycerol does not interfere with their activity. In fact, with respect to the usual collectors used in flotation, it has been found that the polyglycerols permit the use of stronger collectors than can ordinarily be used. These stronger collectors lower flotation tails without overloading the cleaner circuit.

While the precise theory is not precisely understood, it is believed the polyglycerols function by deactivation of the insoluble slimes which generally report to the concentrate.

From the foregoing, it will be seen that the polyglycerols greatly and unexpectedly improve flotation by improving the grade of rougher concentrates, lowering the quantity of the rougher concentrate without adversely affecting the grade of the concentrate, and a higher recovery of the desired mineral (copper) in the final concentrate.

While the invention has been described in connection with preferred embodiments, it is not intended to limit the invention to the particular forms set forth, but, on the contrary, it is intended to cover such alternatives, modifications, and equivalents as may be included within the spirit and scope of the invention as defined by the appended claims.

What is claimed is:

1. In the process of froth flotation concentration of a sulfide mineral which minimizes the collection of slimes and in which an aqueous pulp of an ore containing such mineral is subjected to a flotation operation to produce a final high recovery of such mineral in a flotation concentrate, the improvement comprising carrying out said flotation with a polyglycerol added prior to flotation to deactivate said slimes and present in the aqueous pulp in an amount sufficient to increase recovery of such mineral in the final concentrate over that obtainable without the presence of said polyglycerol.

2. The process of claim 1 wherein the polyglycerol is added to the aqueous pulp in an amount of at least about 0.5 parts per million.

3. The process of claim 2 wherein the sulfide mineral is copper sulfide and the polyglycerol comprises, for each 100 parts by weight thereof, from about 55 to 80 parts by weight of a mixture of glycerol, diglyerol, triglycerol, tetraglycerol, and pentaglycerol, with the glycerol being present in an amount no greater than about 15 parts by weight.

4. The process of claim 3 wherein the polyglycerol comprises, in parts by weight, from about 8 to 14 parts glycerol, about 24 to 30 parts diglycerol, about 10 to 14 parts triglycerol, about 7 to 12 parts tetraglycerol, and about 6 to 9 parts pentaglycerol.

5. The process of claim 1 wherein the polyglycerol is added to the aqueous pulp in an amount from about 0.5 to 100 parts per million.

6. The process of claim 1 wherein the flotation is rougher flotation.

7. The process of claim 1 wherein the flotation is cleaner flotation.

8. In the process of froth flotation concentration of copper sulfide which minimizes the collection of slimes and in which an aqueous pulp of an ore containing copper sulfide is subjected to a rougher flotation operation to make a high recovery of copper sulfide in a rougher concentrate and the rougher concentrate is subjected to a cleaner flotation operation to produce a final high grade copper sulfide flotation concentrate, the improvement comprising carrying out said rougher flotation operation or said cleaner flotation operation with a polyglycerol added prior to flotation to deactivate said slimes and present in the aqueous pulp in an amount of at least about 0.5 parts per million.

9. The process of claim 8 wherein the polyglycerol comprises, for each 100 parts by weight thereof, from about 55 to 80 parts by weight of a mixture of glycerol, diglycerol, triglycerol, tetraglycerol, and pentaglycerol, with the glycerol being present in an amount no greater than about 15 parts by weight.

10. The process of claim 8 in which said rougher and said flotation operations are both carried out with a polyglycerol present in the aqueous pulp.

* * * * *